US011399609B2

(12) United States Patent
Messager et al.

(10) Patent No.: US 11,399,609 B2
(45) Date of Patent: Aug. 2, 2022

(54) DEVICE FOR TREATING THE HAIR HAVING PUSH-RELEASE CARTRIDGE LOCKING

(71) Applicants: L'OREAL, Paris (FR); SEB S.A., Ecully (FR)

(72) Inventors: Edouard Messager, Clichy (FR); Eddy Ngo, Lyons (FR); Martial Maisonneuve, Villefontaine (FR); Xavier Vacheron, Genas (FR); Regis Fereyre, Chavanay (FR)

(73) Assignees: L'OREAL, Paris (FR); SEB S.A., Ecully (FR)

( * ) Notice: Subject to any disclaimer, the term of this patent is extended or adjusted under 35 U.S.C. 154(b) by 496 days.

(21) Appl. No.: 15/576,733

(22) PCT Filed: May 26, 2016

(86) PCT No.: PCT/EP2016/061878
§ 371 (c)(1),
(2) Date: Nov. 24, 2017

(87) PCT Pub. No.: WO2016/189076
PCT Pub. Date: Dec. 1, 2016

(65) Prior Publication Data

US 2019/0110569 A1 Apr. 18, 2019

(30) Foreign Application Priority Data

May 26, 2015 (FR) ..... 1554677

(51) Int. Cl.
*A45D 1/04* (2006.01)
*A45D 34/00* (2006.01)
*A45D 1/00* (2006.01)

(52) U.S. Cl.
CPC ..... *A45D 1/04* (2013.01); *A45D 34/00* (2013.01); *A45D 2001/002* (2013.01);
(Continued)

(58) Field of Classification Search
CPC . Y10S 292/04; A45D 2034/005; A45D 40/02; A45D 1/00; A45D 1/04; A45D 1/06; A45D 34/00
(Continued)

(56) References Cited

U.S. PATENT DOCUMENTS 3,082,869 A * 3/1963 Robert ..... A45D 40/06 401/63
3,955,064 A * 5/1976 Demetrio ..... A45D 1/04 219/225
(Continued)

FOREIGN PATENT DOCUMENTS

CA 2460386 A1 * 9/2004 ..... E05C 19/022
CH 597786 A5 * 4/1978 ..... A45D 1/04
(Continued)

OTHER PUBLICATIONS

International Search Report dated Sep. 1, 2016 in PCT/EP2016/061878 filed May 26, 2016.
(Continued)

*Primary Examiner* — Rachel R Steitz
(74) *Attorney, Agent, or Firm* — Oblon, McClelland, Maier & Neustadt, L.L.P.

(57) ABSTRACT

The invention relates to a device for treating the hair, comprising two arms (16, 18) able to move with respect to one another between a closed configuration for treating the hair and a spread configuration for engaging therebetween the hairs to be treated, one (18) of the arms comprising a housing suitable for receiving a removable hair treatment refill (32), the hair treatment refill (32) comprising a refill
(Continued)

Figure 1:
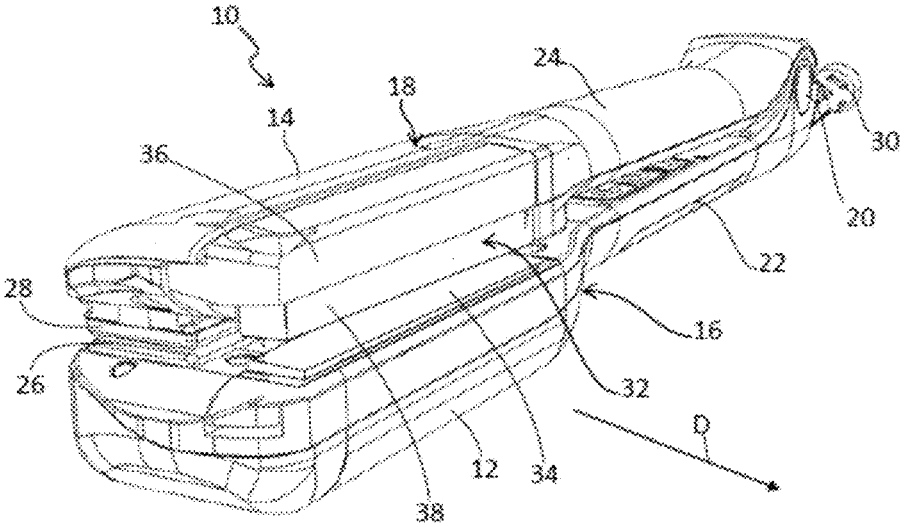

body (36) and an application member (38) attached to the refill body (36), the connection of the refill (32) to the arm (18) being locked by means of a push-release locking device.

11 Claims, 5 Drawing Sheets

(52) U.S. Cl.
CPC .. *A45D 2001/008* (2013.01); *A45D 2034/005* (2013.01); *A45D 2200/1036* (2013.01)

(58) Field of Classification Search
USPC ..... 132/221, 228, 112–116; 15/145, 176.1; 206/385; 222/325–327
See application file for complete search history.

(56) References Cited

U.S. PATENT DOCUMENTS 4,090,522 A * 5/1978 Donley ..... A45D 24/22 132/112
4,792,165 A * 12/1988 Nishimura ..... E05C 19/022 292/19
5,217,262 A * 6/1993 Kurosaki ..... E05C 19/022 292/6
5,273,328 A * 12/1993 Kurosaki ..... E05C 19/022 292/19
5,292,158 A * 3/1994 Kurosaki ..... E05C 19/022 292/19
5,873,379 A * 2/1999 Bouix ..... A45D 40/06 132/318
5,984,381 A * 11/1999 Yamagishi ..... E05C 19/022 267/158
7,004,656 B2 * 2/2006 Kurihara ..... A45D 40/06 401/75
8,752,559 B1 * 6/2014 Tsai ..... A45D 24/22 132/108
9,004,795 B2 * 4/2015 Salciarini ..... A45D 40/10 401/99
9,113,693 B2 * 8/2015 Yan ..... A45D 40/06
2004/0016073 A1 * 1/2004 Knutson ..... A46B 5/0095 15/167.1
2004/0119297 A1 * 6/2004 Bella ..... A45C 11/008 292/300
2006/0285911 A1 * 12/2006 Demellier ..... A45D 40/10 401/75
2008/0156341 A1 * 7/2008 Longoria ..... A45D 8/20 132/277
2009/0019719 A1 1/2009 Yde et al.
2009/0025247 A1 1/2009 Yde et al.
2009/0320534 A1 * 12/2009 Lee ..... E05B 63/24 70/158
2010/0021226 A1 * 1/2010 Hsing ..... A45D 40/02 401/80
2011/0147399 A1 * 6/2011 Salciarini ..... A45C 13/005 220/810
2014/0166038 A1 6/2014 Leung
2014/0219704 A1 * 8/2014 Huang ..... A45D 40/12 401/74
2014/0270891 A1 * 9/2014 McNamara ..... A45D 40/06 401/68
2014/0305465 A1 10/2014 Leung
2015/0052728 A1 * 2/2015 Alexander ..... E05B 47/0009 29/428
2015/0289622 A1 10/2015 Fereyre et al.
2015/0360014 A1 * 12/2015 Decaux ..... A61H 15/0085 604/20
2016/0338480 A1 * 11/2016 Sappenfield ..... F16H 1/46
2017/0303664 A1 * 10/2017 Vanoncini ..... A45D 40/26

FOREIGN PATENT DOCUMENTS

DE 26 40 586 A1 3/1977
DE 10202675 A1 * 7/2003 ..... A45D 40/02
DE 20 2011 051 481 U1 2/2013
EP 1596030 A2 * 11/2005 ..... E05C 19/022
EP 1721543 A1 * 11/2006 ..... A45D 40/00
FR 2927825 A1 * 8/2009 ..... B05B 15/18
FR 2 952 511 A1 5/2011
FR 2981554 A1 * 4/2013 ..... A45D 34/043
WO 2009/015027 A2 1/2009
WO 2009/078046 A1 6/2009
WO 2013/045331 A1 4/2013
WO WO-2013061219 A1 * 5/2013 ..... A61C 17/22
WO 2013/090896 A1 6/2013
WO WO-2013090896 A1 * 6/2013 ..... A45D 37/00
WO 2014/064660 A1 5/2014
WO WO-2015010892 A1 * 1/2015 ..... A45D 2/001
WO WO-2015128572 A2 * 9/2015 ..... B05B 11/0054

OTHER PUBLICATIONS

French Search Report dated Apr. 21, 2016 in French Application 1554677 filed May 26, 2015.
Office Action dated Jan. 31, 2019 in Korean Patent Application No. 10-2017-7037084, 9 pages (with English translation).

* cited by examiner

DEVICE FOR TREATING THE HAIR HAVING PUSH-RELEASE CARTRIDGE LOCKING

The present invention relates to devices for treating the hair, and more particularly, but not exclusively, those intended for shaping the hair, in particular intended for straightening, curling or crimping the hair, comprising a refill of cosmetic product.

The invention relates more particularly to devices comprising two jaws that are able to move with respect to one another and are able to take up a spaced-apart configuration for introducing a lock of hair between said jaws and a moved-together configuration for treating the lock, the jaws being movable along the lock in this moved-together configuration. In such devices, the jaws frequently carry two heating elements with which the hair of the lock is brought into contact during the use of the device.

BACKGROUND

Numerous devices of this type, sometimes also known as hair straighteners or straightening irons, have already been proposed.

Usually, hair straighteners consist of two arms that are connected together with the aid of a hinge which makes it possible to open and close the arms, and of at least one heating element disposed on the arms. During operations of styling a lock of hair, said lock is introduced between the two arms in the open position and then the two arms are closed manually over the lock of hair. The lock of hair is then subjected to the heat output by the heating element(s) until the two arms are opened and the lock of hair is removed.

Application WO 2009/078046 describes a hairstyling appliance comprising two arms that are connected together so as to allow the appliance to be opened and closed, at least one heating member and at least one seat for accommodating a hair treatment device, the latter allowing a haircare product to be dispensed during operation. The hair treatment device is composed of a support material impregnated with a haircare product. The hair treatment device is suitable for a single use.

WO 2009/015027 and US 2009/0025247 disclose a hair-straightening device that makes it possible to apply a haircare product by contact with the hair. The haircare product to be applied is contained in a removable refill for the application thereof. Said removable refill comprises a reservoir containing the haircare product in a gelled form, and orifices for dispensing and applying the product, said orifices being made directly through a wall of the reservoir. The refill is introduced into a housing disposed on one of the two arms of the hair straightener by sliding.

Application WO 2013/045331 likewise discloses an applicator for applying a care substance to the hair, comprising a cartridge of care substance held in a housing of the applicator. The cartridge comprises a porous support saturated with the care substance.

Application WO 2013/090896 relates to a hair treatment appliance, notably a hairstyling appliance, provided with a cartridge of treatment agent that can be removed. The cartridge of treatment agent substantially comprises a treatment agent holder, notably a saturated porous material, to be applied to the hair or the skin, said holder being fastened to an accessory that forms a mechanical holder and a grip tab. The cartridge is mounted in a housing of the hair treatment appliance, said housing having a cross section complementary to the cross section of the cartridge of treatment agent.

According to one embodiment described in application WO 2013/090896, the accessory is in the form of a needle passing through the cylindrical treatment agent holder. At its end away from the grip tab, the needle has a radially extending locking lug which is intended to engage with a complementary locking housing formed in the hair treatment appliance. The locking housing has a portion for the passage of the locking lug and a portion for blocking the locking lug in the longitudinal direction of the accessory in the form of a needle, in the direction of removal of the cartridge, this blocking portion being accessible by the locking lug, from the passage portion, by rotation of the cartridge about the axis of the accessory in the form of a needle. The cartridge is thus fixed in the appliance by means of a bayonet-type locking system.

This latter bayonet-type locking system allows the cartridge of treatment agent to be fitted to/removed from the appliance quickly. However, it entails having a cartridge and a housing of circular cross section. This circular cross section does not appear to be optimal for delivering the treatment agent and applying it to the hair. There is therefore a need to further improve devices for applying a haircare product such that the user can easily refill the device with haircare product and/or change the haircare product to be applied.

SUMMARY

One subject of the invention is thus a device for treating the hair comprising two arms that are movable with respect to one another between a moved-together configuration for treating the hair and a spaced-apart configuration for introducing hair to be treated between said arms, one of the arms comprising a housing designed to receive a removable refill for treating the hair, the hair treatment refill comprising a refill body and an application member fixed to the refill body, the connection between the refill and the arm being locked by means of a locking device of the push-release type.

Such a push-release locking device allows the refill to be released in a particularly simple way, for example by the user simply pressing on the refill body. Furthermore, such a locking device does not dictate a particular geometry for the refill but, rather, can be used regardless of the shape of that refill.

Preferably, the device according to the invention has one or more of the following features, taken alone or in combination:

- the refill body forms a rib intended to be housed in a groove of complementary cross section, formed in the arm, to connect the refill to the arm, or, conversely, the refill body forms a groove intended to accept a rib of complementary cross section, formed on the arm;
- of the arm and the refill body, one forms a projection extending essentially in a direction of insertion of the refill into the housing, the other having a cavity to receive the projection;
- the projection has an ogee shape in the direction of insertion, preferably having at least one, and more preferably still two, overthicknesses in a direction perpendicular to the direction of insertion;
- the receiving cavity is delimited by two arms of a seat, mounted under elastic preload in the direction of insertion by an elastic body;

the arm or arms of the seat are elastic, able to deform through contact with the walls of a chamber receiving the elastic body, upon insertion of the refill into the housing;

the elastic arm or arms of the seat have an overthickness oriented toward the projection, so that the overthickness of the elastic arms is situated behind the overthickness of the projection, in the direction of insertion of the refill into the housing, when the connection between the refill and the arm is locked;

an end stop secured to the arm is formed by a flap, mounted with the ability to rotate on the arm between an open position that allows the refill body to be inserted into the housing in a direction of insertion and allows compression of an elastic body, and a closed position in which the elastic body forces the refill body against the end stop formed on the flap;

the seat forms a lug in a direction perpendicular to the direction of insertion of the refill into the housing, said lug being intended to be received into abutment, in the direction of insertion of the refill into the housing, in a slot formed in one of the walls of the housing, when the refill is fixed to the arm;

the lug is configured to be deformed when, starting from the position in which said lug is in abutment in the slot, a user presses on the refill, in particular on the refill body, in the direction of insertion of the refill into the housing, then releases the refill, in particular the refill body;

of the refill body and the arm, one comprises a follower intended to follow a path formed on the other, the path being configured so as to bring the follower into abutment in the direction of insertion of the refill into the housing, under the effect of the elastic body, upon insertion of the refill into the housing, and to release the follower through further pressure on the refill starting from this position of abutment;

the path essentially comprises a first portion oriented in the direction of insertion of the refill into the housing, a first bend connecting this first portion to a notch forming an end stop for the follower in the direction of insertion of the refill, and a follower guide ramp for directing the follower initially received in the notch out of the ramp and of the first portion when a user presses on the refill again;

the elastic body is a shape-memory body and has two distinct positions:

one of them, compressed, corresponding for example to the position of locking of the connection of the refill to the arm, and the other, relaxed, corresponding for example to a position of releasing of the connection of the refill to the arm;

of the refill body and the arm, one has a part exhibiting symmetry of revolution, free to turn, forming a ramp, for example a helicoidal ramp, and an end stop, the other comprising a claw and a complementary end stop, such that as the refill is being inserted into the housing, the ramp guides the end stop to face the complementary end stop, and that the end stop and the complementary end stop come into contact under the effect of the elastic body and that, starting from this locking position and as a result of pressure on the refill, in the direction of insertion, the claw collaborates with the ramp to angularly offset the end stop with respect to the complementary end stop;

the housing is of elongate shape in the direction of insertion of the refill into the housing;

the application member extends partially outside of the cavity, through an opening;

the application member is made of a porous material, in particular of synthetic or natural fibers that are all oriented substantially in the same direction and assembled and molded to form a felt; and the application member is impregnated with product.

Another aspect of the invention relates to a refill of product for treating the hair, intended to be fixed in a housing of an arm of a device for treating the hair, in particular of a hair treatment device comprising two arms that are movable with respect to one another between a moved-together configuration for treating the hair and a spaced-apart configuration for introducing hair to be treated between said arms, one of the arms comprising the housing designed to removably receive the refill, the refill comprising a refill body and an application member fixed to the refill body, the refill body having either a male element or a female element of a locking device of the push-release type.

Preferably, the refill according to the invention has one or more of the following features, taken alone or in combination:

the refill body forms a rib intended to be housed in a groove of complementary cross section, formed in the arm, to connect the refill to the arm, or, conversely, the refill body forms a groove intended to accept a rib of complementary cross section, formed on the arm;

the refill body comprises a follower intended to follow a path formed on the arm, the path being configured so as to bring the follower into abutment in the direction of insertion of the refill into the housing, under the effect of an elastic body, upon insertion of the refill into the housing, and to release the follower through further pressure on the refill starting from this position of abutment;

the refill body comprises a path intended to accept a follower formed on the arm, the path being configured so as to bring the follower into abutment in the direction of insertion of the refill into the housing, under the effect of an elastic body, upon insertion of the refill into the housing, and to release the follower through further pressure on the refill starting from this position of abutment;

the path essentially comprises a first portion oriented in the direction of insertion of the refill into the housing, a first bend connecting this first portion to a notch forming an end stop for the follower in the direction of insertion of the refill, and a follower guide ramp for directing the follower initially received in the notch out of the ramp and of the first portion when a user presses on the refill again;

the refill body has a male element of a locking device of the push-release type in the form of a projection extending essentially in a direction of insertion of the refill into the housing;

the projection has an ogee shape in the direction of insertion, preferably having at least one, and more preferably still two, overthicknesses in a direction perpendicular to the direction of insertion;

the refill body forms a female element of a locking device of the push-release type in the form of a cavity that receives a projection formed on the arm;

the receiving cavity is delimited by two arms of a seat, mounted under elastic preload in the direction of insertion by an elastic body;

the arms of the seat are elastic, able to deform through contact with the walls of a chamber receiving the elastic body, upon insertion of the refill into the housing;

the elastic arms of the seat have an overthickness oriented toward a projection formed on the arm, so that the overthickness of the elastic arms is situated behind an overthickness of the projection on the arm, in the direction of insertion of the refill into the housing, when the connection between the refill and the arm is locked;

the seat forms a lug in a direction perpendicular to the direction of insertion of the refill into the housing, said lug being intended to be received into abutment, in the direction of insertion of the refill into the housing, in a slot formed in one of the walls of the housing, when the refill is fixed to the arm;

the lug is configured to be deformed when, starting from the position in which said lug is in abutment in the slot, a user presses on the refill, in particular on the refill body, in the direction of insertion of the refill into the housing, then releases the refill, in particular the refill body;

the elastic body is a shape-memory body and has two distinct positions:

one of them, compressed, corresponding for example to the position of locking of the connection of the refill to the arm, and the other, relaxed, corresponding for example to a position of releasing of the connection of the refill to the arm;

the refill body has a part exhibiting symmetry of revolution, free to turn, forming a ramp, for example a helicoidal ramp, and an end stop, and the housing comprises a claw and a complementary end stop, such that as the refill is being inserted into the housing, the ramp guides the end stop to face the complementary end stop, and that the end stop and the complementary end stop come into contact under the effect of the elastic body and that, starting from this locking position and as a result of pressure on the refill, in the direction of insertion, the claw collaborates with the ramp to angularly offset the end stop with respect to the complementary end stop;

the housing has a part exhibiting symmetry of revolution, free to turn, forming a ramp, for example a helicoidal ramp, and an end stop, and the refill body comprises a claw and a complementary end stop, such that as the refill is being inserted into the housing, the ramp guides the end stop to face the complementary end stop, and that the end stop and the complementary end stop come into contact under the effect of the elastic body and that, starting from this locking position and as a result of pressure on the refill, in the direction of insertion, the claw collaborates with the ramp to angularly offset the end stop with respect to the complementary end stop;

the refill body is of elongate shape in the direction of insertion of the refill into the housing;

the application member extends partially outside of the refill body, through an opening;

the application member is made of a porous material, in particular of synthetic or natural fibers that are all oriented substantially in the same direction and molded to form a felt; and the application member is impregnated with product.

Figure 2:
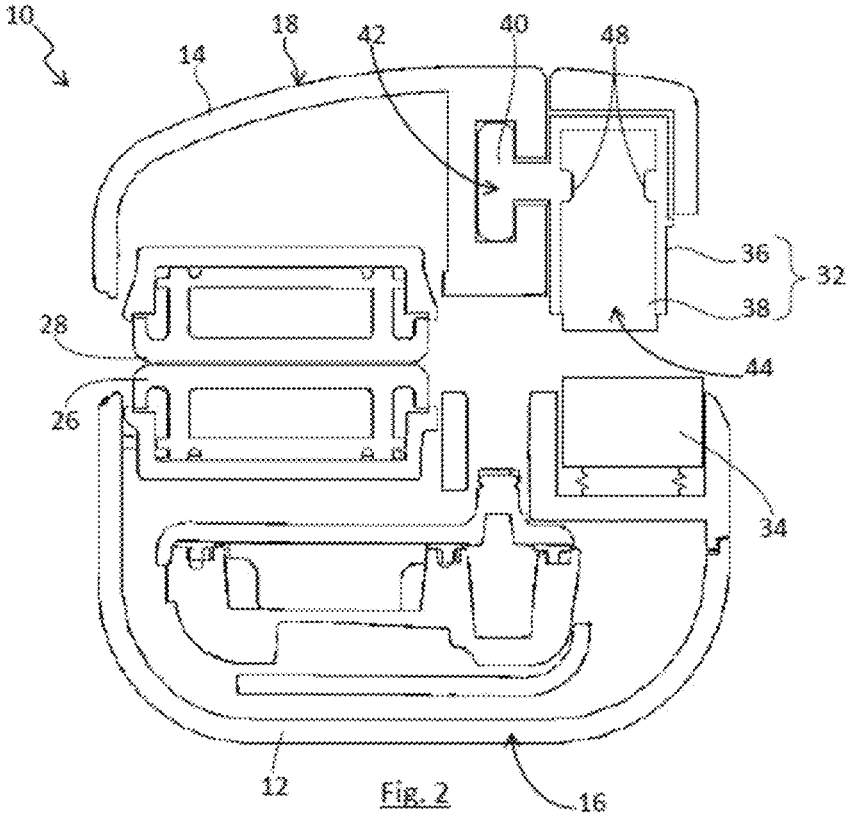
Figure 3:
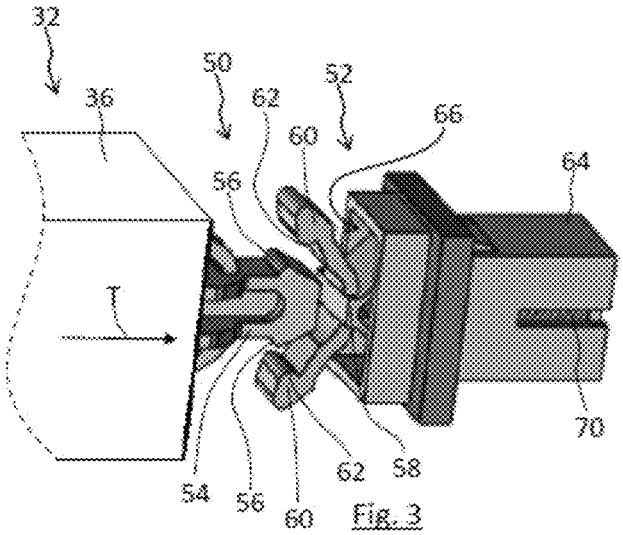
Figure 4:
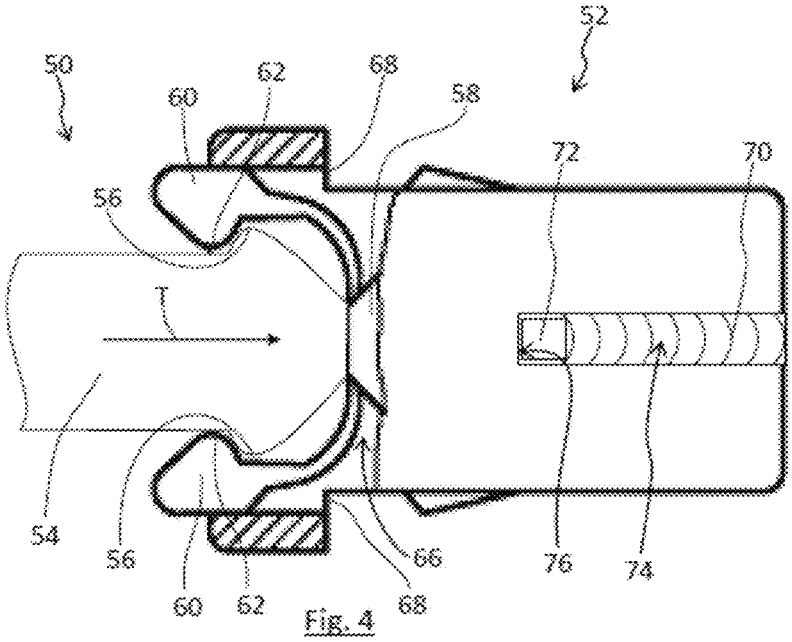
Figure 5:
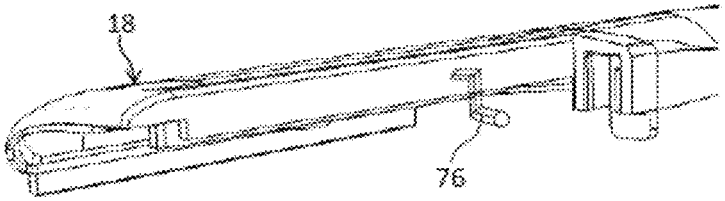
Figure 6A:
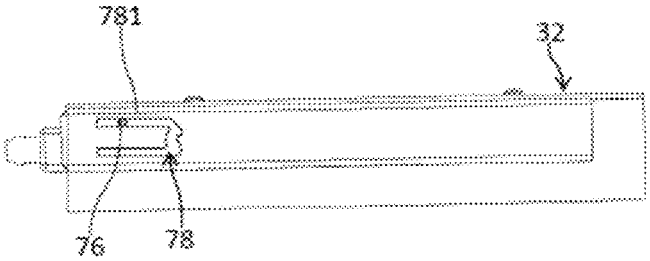
Figure 6B:
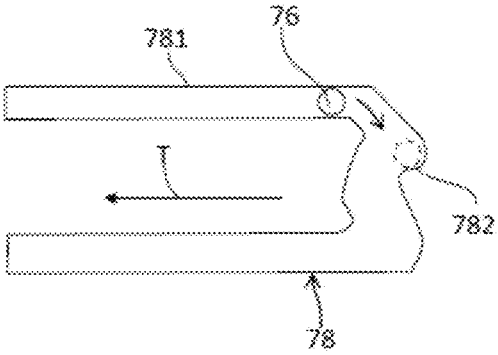
Figure 6C:
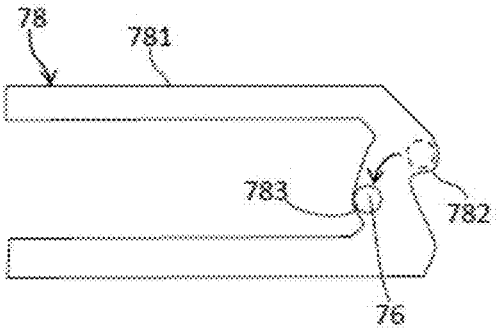
Figure 6D:
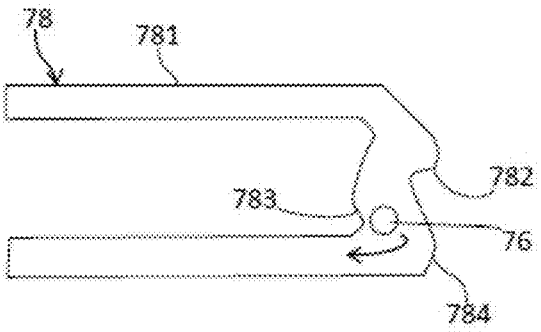
Figure 6E:
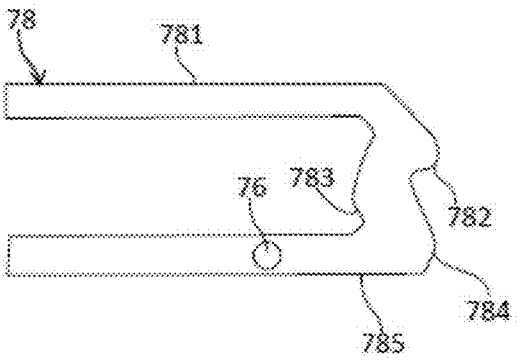
Figure 7:
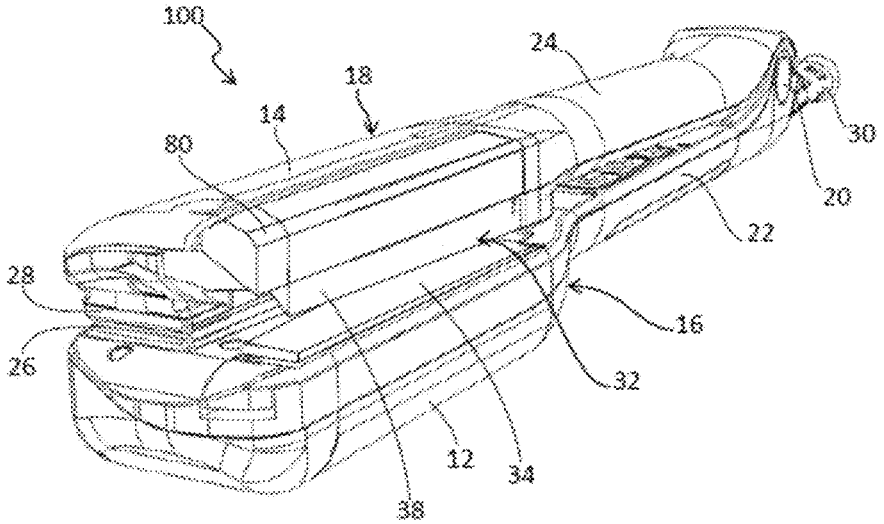

The invention may be understood better from reading the following detailed description of nonlimiting illustrative embodiments thereof and from studying the appended drawing, in which:

FIG. 1 shows a perspective view of an example of a device for treating the hair, FIG. 2 is a cross-sectional view on II-II of the hair treatment device of FIG. 1, FIGS. 3 and 4 illustrate one example of the locking of the refill body into a hair treatment device as illustrated in FIGS. 1 and 2, FIG. 5 illustrates one alternative form of a handpiece for a hair treatment device as illustrated in FIGS. 1 and 2, FIGS. 6*a* to 6*e* illustrate the locking of a refill body into the handpiece of FIG. 5, and FIG. 7 illustrates one alternative form of the device of FIGS. 1 and 2.

In the rest of the description, identical elements or elements having identical functions bear the same reference signs. In order to make the present description concise, they are not described for each of the figures, only the differences between the different examples being described.

A handpiece 10 of an example of a device for treating the hair is shown in FIGS. 1 and 2. The illustrated device for treating the hair is for example a straightener having flat heating elements, which notably come into contact in the closed position.

The handpiece 10 has two jaws 12 and 14 that are able to move with respect to one another between a spaced-apart configuration (not shown) for the introduction between said jaws of a lock of hair and a moved-together configuration for treating the lock of hair.

The jaws 12, 14 are carried by a lower arm 16 and an upper arm 18, respectively. The lower arm 16 and upper arm 18 are, in the example in question, hinged with respect to one another by means of a hinge pin 20, the handpiece 10 thus forming tongs.

The lower arm 16 and upper arm 18 in this case each have a total length of between 22 cm and 37 cm, notably 31 cm. The lower arm 16 and upper arm 18 define, between the hinge pin 20 and the jaws 12, 14, respective half-handles 22, 24 on which the user can press in order to move the jaws 12, 14 together.

An elastic return member (not visible) can be provided to return the jaws 12, 14 into the spaced-apart configuration. This elastic return member can, for example, be in the form of a spring disposed around the hinge pin 20 of the lower arm 16 and upper arm 18.

Of course, the jaws 12, 14 can be rendered movable with respect to one another in some other way. They can notably be movable with respect to one another not by rotation, as is the case with a hinge, but by movement in translation. However, preference is given to the ergonomics provided by a hinge.

The jaws 12, 14 define between one another a region for treating the hair, said region being intended to receive a lock of hair to be treated, the handpiece 10 being moved along said lock during the treatment. The handpiece is moved for example in the direction from the root to the tip of the hair of the lock.

In the example in FIGS. 1 and 2, the handpiece 10 makes it possible to apply a cosmetic product for carrying out a treatment of the hair by way of steam, and then to carry out a thermal treatment of the hair by contact with two hot surfaces 26, 28 that are respectively carried by each of the jaws 12, 14.

The direction D of movement of the handpiece 10 over the hair, illustrated in FIG. 1, is preferably substantially perpendicular to the median axis of the lower arm 16 and upper arm 18, that is to say substantially parallel to the hinge pin 20.

In the example illustrated, the handpiece 10 is connected by a lead 30 to a base station (not shown) that is fixed during the treatment and is itself connected to the mains. This base station provides the electric power supply to the handpiece 10 and also its supply of water in order to generate steam. The base station can also carry out additional functions of processing electrical signals received from the handpiece 10. The lead 30 that connects the handpiece 10 to the base station may thus comprise various electrical conductors and a water supply pipe.

A user interface (not shown in the figures) can also be present on the handpiece 10, for example so as to allow the user to start up certain components thereof, or not.

The cosmetic product is applied by a refill 32 carried by one of the two arms 16, 18, in this case the upper arm 18, which comes into contact with a pressing element 34. The pressing element 34 is received, in a removable manner, in a housing formed, in this instance, in the lower arm 16. The pressing element is, in this instance, movable in its housing. The refill 32 is received in a housing formed in the upper arm 18, with an elongate shape in the direction of insertion of the refill.

The opposite arm to the arm on which the refill 32 is arranged may have a steam outlet, and preferably also a comb. Preferably, in particular when the hair is intended to be straightened, the device comprises a heating element intended to come into contact with the hair, or better still, two heating elements, each disposed on an arm. This or these heating element(s) may each comprise a plate, made of a material that is a good conductor of heat, that defines a hot surface for contact with the hair, the temperature of said surface being for example greater than or equal to 95° C., better still between 90 and 230° C. Also preferably, the application of product to the lock of hair introduced into the device is performed before the application of steam and/or straightening by the heating element(s) and after combing. Thus, the hair introduced between the arms can come into contact with the application member before being exposed to the steam and to the heating elements while the lock is being moved between the arms of the device.

The refill 32 (or cartridge) comprises a body 36 and an application member 38 received in the body such that, when the refill 32 is fastened to the appliance, the application member 38 is able to come into contact with the hair extending through the treatment region.

The body 36 has a recess 44 that opens toward the outside by way of an opening 46 that receives the application member 38. More specifically, the application member projects out of the recess 44 in order to be able to be in contact with a lock of hair to be treated.

The body 36 of the refill 32 may comprise coupling reliefs 48 that project into the recess 44 and keep the application member 38 in position in the recess 44, even during the application of the cosmetic product to the lock of hair.

The coupling reliefs 48 may be molded together with the body 36. The body 36 and the coupling reliefs 48 may notably be made of thermoplastic material, notably polybutylene terephthalate (PBT), polyethylene terephthalate (PET), polyamide (PA), elastomer or a mixture thereof, in particular a mixture of PBT and PET.

The application member is made for example of a porous material, notably of synthetic or natural fibers that are all oriented substantially in the same direction and molded to form a felt. The application member is impregnated with product.

The refill 32 may be connected to either the lower arm 16 or upper arm 18 (in this case the upper arm 18). The refill 32 is connected to the arm 18 which receives it in a housing provided to this end, by any means. Notably, as illustrated in FIG. 2, the refill 32 is received by sliding a rib 40 of the body 36 into a groove 42 of complementary cross section formed in the arm 18, in a direction of insertion of the refill into its housing. This connection ensures a relative position of the refill 32 with respect to the arm 18, notably with respect to the direction D of movement of the handpiece 10. In a variant, the rib may be formed on the arm 18 and the groove in the body 36.

In order to lock the connection between the refill 32 and the arm 18, the refill 32 is, in this instance, provided with a male part 50 of a locking device of the push-push (push-release) type, the arm 18 being provided with a corresponding female part 52 of a locking device of the push-push type.

A locking device of the push-push, or push-release, type is understood to be a system that allows:

- a male element to be locked with respect to a female element by a simple relative movement in translation of the male element with respect to the female element in one direction and one sense, and
- the male element to be unlocked with respect to the female element by a relative movement in translation of the male element with respect to the female element in the same direction and the same sense.

For example, the male element can be locked and unlocked by being pressed in a direction and a sense that are directed toward the female element.

Preferably, the locking and unlocking consists of a push on the male element in one and the same direction and one and the same sense, without any other manipulation or any other relative movement of the male element with respect to the female element.

Locking of a male element with respect to a female element is understood as meaning that a relative movement of the male element with respect to the female element is impossible, or at least prevented by the locking system. Such a system can be used alone in order to connect the refill to the arm. However, in order to ensure better stability of the connection of the refill to the arm, a connecting device is used in addition to the locking device (in this instance, the collaboration between the rib 40 and the groove 42).

Such a push-push locking device provides great ease of locking and unlocking of the connection of the refill 32 to the handpiece 10 compared with the devices known from the documents of the prior art.

One first example of a push-push locking device is illustrated in FIGS. 3 and 4, in the unlocked position and in the locked position, respectively.

In the case illustrated in these figures, the male element 50 of the locking device of push-push type essentially consists in a projection 54 arranged at one end of the refill 32 and extending essentially in the direction of insertion of the refill 32 into the arm 18. The projection 54 in this instance has an ogee shaped cross section with symmetrical bulges 56 (or a cross section in the shape of a mushroom cap). The bulges 56 form an overthickness in a direction perpendicular to the direction of insertion of the refill into its housing The female element 52, secured to the arm 18, itself comprises an element 58 for receiving the projection 54 (or receiving slide or seat). This receiving element 58 in this instance comprises two symmetrical arms 60 that are flexible, which means to say able to deform. These symmetrical arms 60 also have, in the vicinity of their respective free end, a bulge 62. This bulge 62 also forms an overthickness in a direction perpendicular to the direction of insertion of the refill into the housing, in the position in which the connection between the refill and the arm is locked, this overthickness being directed toward the projection 54 of the male element. This receiving element 58 is mounted under elastic preload with respect to a framework 64 fixed to the arm 18 or formed directly in this arm 18. This framework 64 forms a cavity 66 intended in particular to at least partially receive the receiving element 58 and part of the projection 54 of the male element. This cavity 66 is, in this instance, of substantially rectangular parallelepipedal form, with a shoulder 68.

The receiving element 58 is mounted under preload in the cavity 66 by means of a spring 70 housed in the cavity 66. The spring 70 tends to cause the receiving element 58 to exit the cavity 66. The exited position of the receiving element 58 may be defined by an abutment of the receiving element on a wall of the cavity 66.

The receiving element 58 moreover comprises a lug 72 (visible in FIG. 4) able to come into abutment, under the effect of the spring 70 and when the device of the push-push type is in the locked position, in a groove 74 hollowed into a wall of the framework 64. The groove 74 preferably extends substantially in the direction of insertion of the refill into the housing.

The way in which this locking device of the push-push type works is as follows.

The projection 54 of the male element of the locking device is introduced into the receiving element 58, namely between the two symmetrical arms 60 of this receiving element 58, in a translational movement in the direction of insertion T. It continues to be pushed in the direction of insertion T so that the arms 60 of the receiving element bend over into contact with the edge of the cavity 66 formed by the framework 64. As they do so, the bulges 62 of the arms of the receiving element 58 position themselves behind—with respect to the direction of insertion T—the bulges 56 of the projection 54 of the male element. The bending-over of the arms 60 of the receiving element thus allows better guidance of the projection 54 and therefore of the male element 50 with respect to the female element 52. It should be noted here that this pushing on the male element 50 is performed against the action of the return force of the spring 70.

The male element 50 then continues to be pushed until the lug 72 of the receiving element 58 is fully received in the groove 74. The male element is then released. It is held in place because the spring 70 forces the lug 72 into abutment against the end 76 of the groove 74 (end with respect to the direction of insertion T) and because, in this position, the arms 60 of the receiving element 58 are bent over and trap the projection 54. In particular, the bulges 62 of the arms 60 of the receiving element 58 are in abutment against the bulges 56 of the projection 54 in the direction of insertion T of the refill into the housing.

In order to unlock the male element 50 with respect to the female element 52, the male element 50 is pushed again in the direction of insertion, and in the same sense, for example until the arms 60 of the receiving element 58 come into abutment against the shoulder formed by the framework delimiting the cavity 66. The spring 70 can then be loaded enough to overcome the end stop liable to be formed by contact between the lug 72 and the end 76 of the groove 74. In releasing the male element 50, the spring 70 then applies a pushing force to the receiving element 58 such that the lug 72 is deformed in contact with the bottom of the groove 74 and is unable to form an end stop. The receiving element is moved in the direction of insertion T, but in the opposite sense, so that the arms 60 of the receiving element 58 are released and deploy again, thus releasing the projection 54 of the male element 50.

As an alternative to this locking device of the push-push type, the spring 70 or any other elastic element used to elastically load the receiving element may be a shape-memory element. In particular, the spring 70 may have two distinct positions:

one of them, compressed, corresponding to the position of locking of the connection of the refill to the arm, and the other, relaxed, corresponding to the position of releasing of the connection of the refill to the arm.

In this case, it is possible for the receiving element 58 not to form an end stop intended to collaborate with the bottom of a groove formed in a fixed framework. The spring 70 may switch from one position to the other by simple pushing in the direction of insertion of the refill into the housing. The locking of the connection is achieved through the fact that the spring has a fixed shape in which the projection is trapped in the receiving element. In particular, the collaboration between the bulges of the arms of the receiving element and the projection prevents the latter from being removed from the receiving element.

FIGS. 5 and 6*a*-6*e* illustrate another locking device of the push-push type that can be used to lock a refill onto a handpiece.

In this locking device of the push-push type, it is possible for the receiving element not to comprise a lug intended to come into abutment against the bottom of a groove in the framework. This is because in this instance the end stop is created on a peg (or follower) 76 secured to the arm of the handpiece and housed in a path 78 formed on the body of the refill (possibly on a surface of the rib 40).

The peg 76 is produced by means of a Z-shaped component mounted with the freedom to rotate at one of its ends on the arm of the handpiece 10. The opposite end of this Z-shaped component (or free end) is intended to be housed in the path 78 produced on the refill and visible in FIGS. 6*a*-6*e* upon insertion of the refill into the housing formed in the arm. The shape of this path is described hereinafter with reference to FIGS. 6*a*-6*e* which illustrate the locking and unlocking of the connection of the refill to the arm.

First of all, the path 78 comprises a first portion 781 extending parallel to the direction of insertion T of the refill into the housing. This portion allows the insertion of the refill to be guided (FIG. 6*a*) from an end of the path 78 that allows the peg 76 to enter this path 78.

This first portion 781 opens into a bend 782 (FIG. 6*b*), which allows the user inserting the refill into the housing to be informed that he has reached the desired position for the refill. This bend 782 effectively forms an end stop against inserting the refill beyond its housing, that is readily recognizable by the user since the peg 76 is in abutment against the bend, as indicated in dotted line in FIGS. 6*b* and 6*c*.

The user then releases the pressure on the refill body. The spring 70 then pushes the refill 32 back slightly, allowing the peg 76 to follow the bend 782 as far as a notch 783 (FIG. 6*c*) that forms an end stop for the peg 76 in the direction of insertion of the refill into the housing, against the action of the spring 70. In this position of the peg 76 housed in the notch 783, the connection between the refill 32 and the arm is locked.

The user then pushes the refill again in the direction and sense of insertion of the refill. He thus causes the peg 76 to exit the notch 783, the peg 76 then coming into contact with a ramp 784 of the path 78 (FIG. 6*d*). This ramp 784 allows the peg 76 to be guided out of the notch 783 and out of the first portion 781, toward a second portion 785 parallel to the first portion 781 (FIG. 6*e*). In order to achieve this, the ramp 784 extends facing the notch 783 in the direction of insertion of the cartridge into the housing.

By thus releasing the pressure on the refill 32, the user allows the spring 70 to push on the refill 32. In this case, the peg 76 follows the second portion 785 as far as a second end of the path 78 allowing the peg 76 to be released and thus the locking of the connection between the refill and the arm to be released.

According to yet another example which has not been illustrated, the refill body has a part exhibiting symmetry of revolution, free to rotate about an axis parallel to the direction of insertion of the refill into its housing. This part exhibiting symmetry of revolution may in particular be cylindrical, tubular, conical or frustaconical. This part forms a ramp, for example a helicoidal ramp, and an end stop. The end stop preferably extends over a limited angular section of the part exhibiting symmetry of revolution. The arm itself comprises a claw, intended to collaborate with the ramp, and an end stop that complements the end stop formed on the refill body. Thus, during the insertion of the refill into the housing, the collaboration between the claw and the ramp guides the end stop of the refill to face the complementary end stop formed on the arm such that the end stop and the complementary end stop come into contact under the effect of the elastic body in the locking position of the connection between the refill and the arm. Starting from this locking position and following further pushing on the refill, in the direction of insertion, the collaboration between the claw and the ramp angularly offsets the end stop of the refill from the complementary end stop of the arm. If the pushing action is ceased, the spring 70 then pushes the refill back out of its housing in the arm, thus releasing the locking of the connection between the refill and the arm.

FIG. 7 illustrates yet another alternative form 100 of a handpiece of an example of a device for treating the hair.

In this alternative form, the refill is inserted into its housing against the action of the spring 70 until the projection of the male element is trapped in the receiving element of the female element. A flap 80 is provided in this instance on the arm 18 and has an open position that allows such an insertion of the refill into its housing.

Once the male element is trapped in the receiving element of the female element, the user folds the flap 80 down into a closed position to form a mechanical end stop that prevents the spring 70 from pushing the refill back out of its housing. In this position, the spring 70 elastically forces the refill against an end stop formed on or by the flap 80. In order to do this, the flap 80 is pivot-mounted on the arm 18, in this instance to pivot about an axis parallel to the direction of insertion of the refill 32 into its housing.

In order to unlock the connection between the refill and the arm, the user pushes again on the refill, in the same direction and the same sense as used for inserting it into its housing, and lifts the flap 80. By thus releasing the refill, he allows the spring 70 to push the refill 32 back out of its housing.

The present invention offers the advantage of locking the refill when the latter is situated at the bottom of its housing, namely in its position of use.

Preferably, the male element—the simpler element—is incorporated into the body of the refill, and the female element—which is more complex—is integrated into the arm of the device in order to reduce the cost of manufacture of the refills. However, the reverse configuration (male element on the arm of the device, female element on the refill) is also conceivable.

The proposed solution also makes it possible to dispense with a specific locking button that the user has to operate. The device thus exhibits a more uncluttered appearance, much appreciated by users. The invention also makes it possible to offer an appliance that is easier to clean.

The proposed solution is also very reliable. The locking device of push-release type gives the cartridge-fixing function a technological aspect that is much appreciated by users. This locking device further contributes to guaranteeing the user that only compatible cartridges can be used with the hair treatment device, so as to provide optimum treatment of the hair and/or to ensure that the appliance is able to operate correctly, which might not be the case with incompatible cartridges.

The invention is not limited to the illustrative embodiments just described, the features of which may be combined with one another within variants that are not illustrated.

Furthermore, the mechanical end stops described for keeping the locking device in the locked position may be replaced by magnetic elements, particularly magnets, the attraction between two magnets replacing the formation of a mechanical end stop.

The expression "comprising a" should be understood as being synonymous with "comprising at least one".

The invention claimed is:

1. A refill of product for treating the hair, for removable receipt in a device for treating the hair, the refill comprising:

a refill body of elongate shape along a longitudinal axis; and an application member fixed to the refill body, wherein the refill body forms either:

a rib extending from a lateral surface of the refill body along the longitudinal axis of the refill body configured for being received by sliding during use into a groove of complementary cross section, formed in the device for treating the hair, or conversely, a groove extending from a lateral surface of the refill body along the longitudinal axis of the refill body configured for accepting by sliding a rib of complementary cross section formed on the device for treating the hair, during use, wherein the refill body has either:

a male element of a locking device of the push-release type different from the rib, the male element being in the form of a projection extending along the longitudinal axis of the refill body at one longitudinal end of the refill body, the projection having at least one overthickness in a direction perpendicular to longitudinal axis of the refill, or a female element of the locking device of the push-release type different from the groove, the female element comprising a receiving element comprising two arms that are flexible for receiving between them a projection of a male element on the device for treating the hair, the arms of the receiving element having, in the vicinity of their respective free end, an overthickness in a direction perpendicular to the longitudinal axis of the refill into the housing, in the position in which the connection between the refill and the device for treating the hair is locked, this overthickness being directed toward the projection of the male element on the device, the receiving element being mounted under elastic preload with respect to a cavity of the female element opening at one longitudinal end of the refill body by an elastic element, the female element being configured to take two distinct configurations during use:

a locked configuration in which the receiving element is received in the cavity and the two arms are bent over into contact with an edge of the cavity such that the overthickness is positioned behind a projection of the male element on the device, and a release configuration in which the two arms of the receiving element are deployed, the female element being configured to pass:

from the release configuration to the locked configuration by pushing on the refill body along the longitudinal axis of the refill body by a relative movement in translation of the female element of the refill with respect to the male element of the device for treating the hair along the longitudinal axis of the refill body in a sense that is directed toward the male element of the device for treating the hair without any other manipulation and any other relative movement of the male element with respect to the female element, and from the locked configuration to the release configuration by pushing on the refill body along the longitudinal axis of the refill body by a relative movement in translation of the female element of the refill with respect to the male element of the device for treating the hair along the longitudinal axis of the refill body in the same sense without any other manipulation and any other relative movement of the male element with respect to the female element.

2. The refill as claimed in claim 1, in which the refill body comprises a follower for following a path formed on the device for treating the hair during use, the follower being configured to be brought during use into abutment with a wall of the path in the direction of insertion of the refill in the housing, under the effect of the elastic element in the cavity of the female element of the locking device of the push-release type of the refill when the refill body has the female element of the locking device of the push-release type or of an elastic element in a cavity of a female element of the device for treating the hair when the refill body has the male element of the locking device of the push-release type, upon insertion of the refill into the housing, and to be released during use through further pressure on the refill starting from this position of abutment.

3. The refill as claimed in claim 1, in which the refill body comprises a path for accepting during use a follower formed on the device for treating the hair, the path being configured to bring during use the follower into abutment with a wall of the path in the direction of insertion of the refill into the housing, under the effect of an elastic body in the cavity of the female element of the locking device of the push-release type of the refill or in the cavity of the female element of the device for treating the hair when the refill body has a male element of the locking device of the push-release type, upon insertion of the refill into the housing, and to release during use the follower through further pressure on the refill starting from this position of abutment.

4. The refill as claimed in claim 1, in which the male element of the locking device of the push-release type in the form of a projection that has an ogee shape in the direction of insertion.

5. The refill as claimed in claim 1, in which the female element of the locking device of the push-release type in the form of a cavity is for receiving during use a projection formed on the device for treating the hair.

6. The refill as claimed in claim 1, in which the arms of the receiving element of the female element form a lug in a direction perpendicular to the direction of insertion of the refill into the housing, said lug being configured to be received during use into abutment, in the direction of insertion of the refill into the housing, against a wall of a slot formed in one of walls of the housing, when the refill is fixed to the device for treating the hair.

7. The refill as claimed in claim 6, in which the lug is configured to be deformed when, starting from the position in which said lug is in abutment against the wall of the slot, a user presses on the refill in the direction of insertion of the refill into the housing, to compress the elastic body such that the latter exerts a pressure on the lug that is high enough to overcome the retaining force exerted by the slot and then releases the refill.

8. The refill as claimed in claim 1, in which the elastic element is a shape-memory body and has two distinct positions during use:

one of them, compressed, and the other, relaxed.

9. The refill as claimed in claim 1, in which the application member extends partially outside of the refill body, through an opening of the refill body.

10. The refill as claimed in claim 1, in which the application member is made of a porous material.

11. The refill as claimed in claim 1, in which the application member is impregnated with product.

* * * * *